US008381674B2

(12) United States Patent
Chang

(10) Patent No.: US 8,381,674 B2
(45) Date of Patent: Feb. 26, 2013

(54) AUTOMATED FLUID DISPENSER

(75) Inventor: Corina Chang, Ancaster (CA)

(73) Assignee: Toyota Motor Engineering & Manufacturing North America, Inc., Erlanger, KY (US)

( * ) Notice: Subject to any disclaimer, the term of this patent is extended or adjusted under 35 U.S.C. 154(b) by 520 days.

(21) Appl. No.: 12/692,939

(22) Filed: Jan. 25, 2010

(65) Prior Publication Data

US 2011/0179995 A1 Jul. 28, 2011

(51) Int. Cl.
*B05C 5/02* (2006.01)
*B05D 5/10* (2006.01)

(52) U.S. Cl. ..... 118/300; 118/410; 118/503; 427/427.2; 427/356

(58) Field of Classification Search ..... 118/300, 118/DIG. 2, 410, 419, 503; 427/427.2, 424, 427/356; 901/31, 42, 43; 222/526, 533, 222/153.13; 239/516, 519; 156/578
See application file for complete search history.

(56) References Cited

U.S. PATENT DOCUMENTS

| | | | | |
|---|---|---|---|---|
| 3,171,012 | A | 2/1965 | Morehead | |
| 3,510,626 | A | 5/1970 | Hasegawa | |
| 4,468,695 | A | 8/1984 | Ikeda et al. | |
| 4,563,788 | A | 1/1986 | Kobayashi | |
| 4,809,885 | A * | 3/1989 | Hayashi et al. | 222/174 |
| 4,951,849 | A | 8/1990 | Townsend et al. | |
| 4,969,604 | A | 11/1990 | Smith | |
| 5,194,791 | A | 3/1993 | Cull | |
| 5,377,913 | A | 1/1995 | Van Der Woude | |
| 5,541,382 | A * | 7/1996 | Taylor et al. | 219/86.25 |
| 5,697,534 | A | 12/1997 | Huyghe | |
| 6,197,115 | B1 | 3/2001 | Barrey et al. | |
| 6,736,900 | B2 * | 5/2004 | Isogai et al. | 118/663 |

FOREIGN PATENT DOCUMENTS

| | | |
|---|---|---|
| JP | 11-136429 A | 5/1999 |
| JP | 2003-387570 A | 6/2005 |

* cited by examiner

*Primary Examiner* — Laura Edwards
(74) *Attorney, Agent, or Firm* — Gifford, Krass, Sprinkle, Anderson & Citkowski, P.C.

(57) ABSTRACT

An automated fluid dispenser for smoothly applying a viscous fluid onto a component is provided. The automated fluid dispenser can have a nozzle with a nozzle tip and a support. The nozzle can be pivotally attached to the support about a pivot axis. In addition, a tension member can be attached to the nozzle, the tension member applying an anti-pivoting force to the nozzle when it pivots about the pivot axis.

17 Claims, 3 Drawing Sheets

AUTOMATED FLUID DISPENSER

FIELD OF THE INVENTION

The present invention is related to a fluid dispenser. In particular, the invention is related to a fluid dispenser for applying a viscous liquid onto a panel.

BACKGROUND OF THE INVENTION

The application of viscous liquids such as adhesives, sealants, etc., using automated fluid dispensers is known. The automated fluid dispenser typically forces a viscous liquid through a nozzle and onto a component such as a panel, window frame, door frame, and the like. In addition, assembly line manufacturing uses automated fluid dispensers to apply viscous liquids onto components assembled on the assembly line.

Robots are also used in assembly line operations to increase production efficiency and quality, reduce overall costs and the like. However, robots have limitations when a "human touch" is needed to perform a particular operation. For example, the application of a strip or bead of sealant around an edge portion of a panel can require the flexibility of a human arm and/or wrist in order to provide a smooth bead of the sealant onto the panel. In addition, the use of robots to hold the panel and/or a fluid dispenser and move one relative to the other as a viscous liquid is applied to the panel can result in undesirable vibrations of the panel and/or dispenser, respectively, thereby causing a wavy or rough surfaced bead to be applied to the panel.

Looking particularly at FIGS. 1 and 2, a prior art embodiment of an automated fluid dispenser is shown generally at reference numeral 10 where a viscous liquid 350 is applied to a panel 200 using a robot 100 and a fluid dispenser 300. As shown in this figure, the fluid dispenser 300 is held in a fixed position by a support 310 while the panel 200 is moved underneath the dispenser 300 and the viscous liquid 350 is forced through a nozzle 330 and nozzle tip 340. It is appreciated that the fluid dispensing valve 320 can be in fluid communication with a reservoir of the viscous liquid 350.

The robot 100 can have one or more clamps 110 that grasp the panel 200, the clamps 110 being attached to one or more arms 120. With the rotation of the arms 120 about an axis 102 in a first direction 1 and movement of a main robot arm 130 in a second direction 2, the robot 100 can move the panel 200 underneath the nozzle tip 340 along a predetermined path at a predetermined speed while the viscous liquid 350 is applied to an edge region 210. However, vibration of the panel 200 during application of the viscous liquid 350 can result in a surface 352 that is wavy with low regions 351 and high regions 353 as shown in FIG. 2. Such a wavy surface can be unattractive if visible to an individual and/or provide a non-uniform surface that can result in a poor seal between the panel 200 and a mating component (not shown). As such, a fluid dispenser that provides a smooth bead onto a component with the use of a robot would be desirable.

SUMMARY OF THE INVENTION

An automated fluid dispenser for applying a smooth bead of viscous fluid onto a component is provided. The automated fluid dispenser can have a nozzle with a nozzle tip and a support. The nozzle can be pivotally attached to the support about a pivot axis and a tension member can be attached to the nozzle, the tension member applying an anti-pivoting force to the nozzle when it pivots about the pivot axis. In this manner, the nozzle can have a tensioned pivoting movement that generally simulates motion of a human wrist and/or elbow and a viscous fluid can be smoothly applied to a component brought into motional contact with the nozzle tip and displaced there across at a predetermined speed. In some instances, a robot holds and displaces the component across the nozzle tip at the predetermined speed.

The anti-pivoting force provided by the tension member can keep the nozzle tip in general contact with the component as the component is displaced across the tip. In some instances, the anti-pivoting force can be between 0.4 and 0.6 kilogram/force. In addition, the tension member can be a coil spring.

A process for applying a smooth bead of viscous fluid onto a component is also provided. The process includes providing a component such as a panel, door frame, window frame and the like. In addition, the automated fluid dispenser described above is provided and the component is placed into motional contact with the nozzle tip such that the nozzle pivots about the pivot axis a predetermined amount. The component is displaced across the nozzle tip along a predetermined path at a predetermined speed, and a viscous fluid is forced through the nozzle tip at a predetermined flow rate. The tension member applying the anti-pivoting force to the nozzle keeps the nozzle tip in general contact with the component and results in a smooth bead being applied to the component. As stated above, a robot can hold and move the component along a predetermined path at a predetermined speed relative to the nozzle tip.

DETAILED DESCRIPTION OF THE INVENTION

Figure 1:
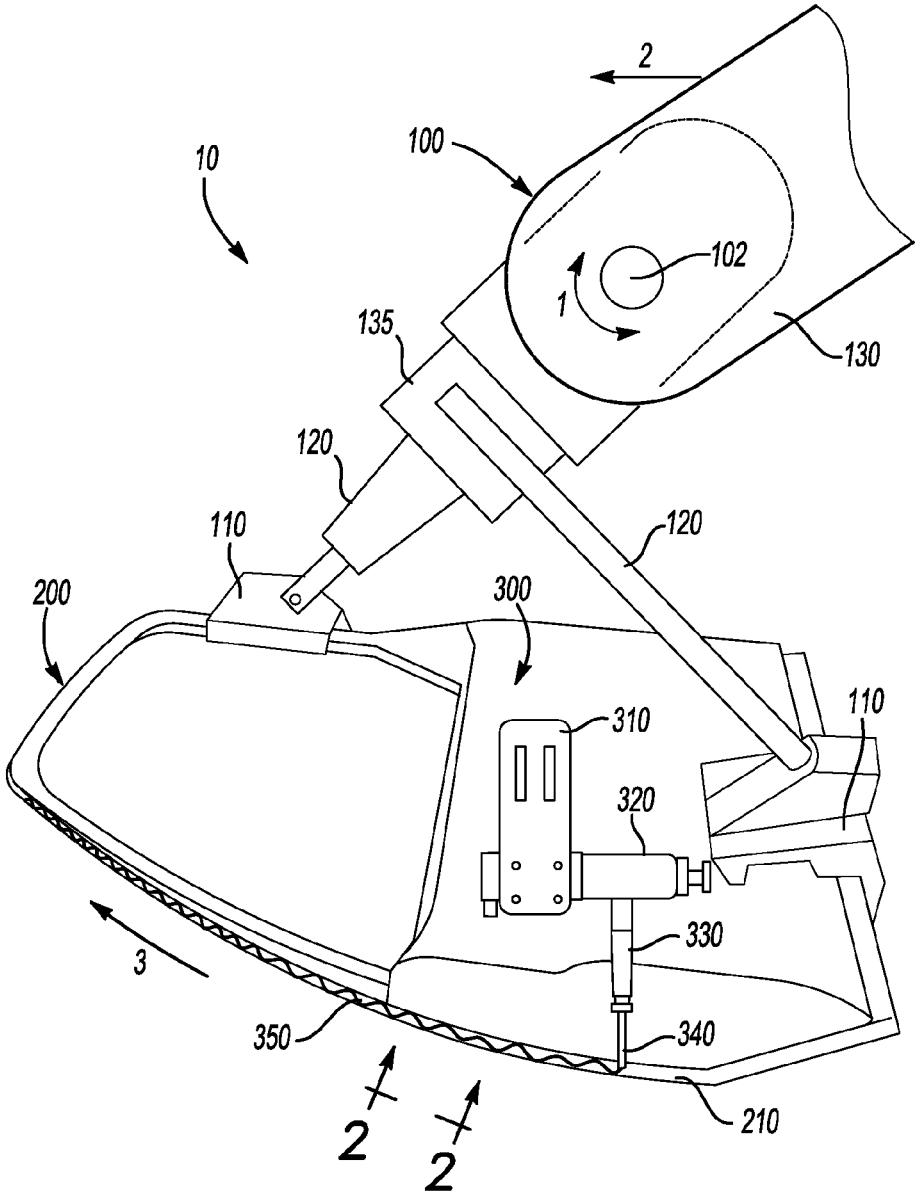
Fig-1 PRIOR ART
FIG. 1 is an illustration of a prior art automated fluid dispenser.
Figure 2:
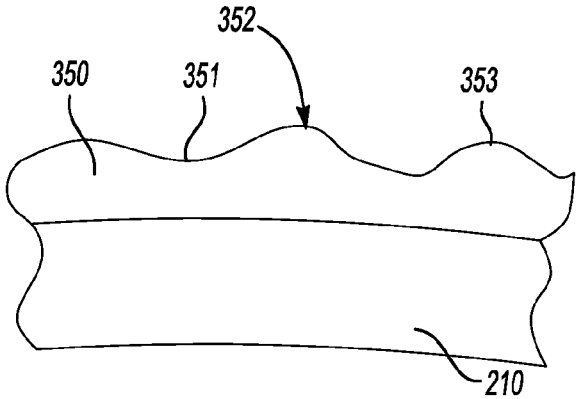
Fig-2 PRIOR ART
FIG. 2 is a side view of a bead of viscous liquid applied to a component using the automated fluid dispenser illustrated in FIG. 1.

The present invention provides an automated fluid dispenser for producing a smooth bead of a viscous liquid onto a component. As such, the automated fluid dispenser has utility for use in the assembly of machines.

The automated fluid dispenser has a pivot axis in combination with a tension member such that it operates generally similar to a human wrist and/or elbow. In this manner, a smooth bead of the viscous liquid can be applied to a component such as a panel even when small vibrations are present during the application.

The automated fluid dispenser can have a nozzle with a nozzle tip and a support to which the nozzle is pivotally attached about a pivot axis. The tension member is attached to the nozzle and applies an anti-pivoting force to the nozzle when it pivots about the pivot axis. A component can be brought into motional contact with the nozzle tip and traverse a predetermined path at a predetermined speed. In some instances, a robot can be provided that can hold and displace the component relative to the nozzle tip and/or the robot can displace the nozzle tip relative to the component.

For the purposes of the present invention, the term "motional contact" is defined as movement of a component relative to a nozzle tip while the nozzle tip is in general contact with the component. The term "general contact" includes the nozzle tip being in actual contact with the component and the nozzle tip being spaced apart from the component a small predetermined distance while the component moves relative to the tip due to the flow of viscous liquid from the nozzle tip. Stated differently, the flow of viscous liquid from the nozzle tip can cause the tip to be raised slightly above and/or spaced apart from the component surface while the anti-pivoting force provided by the tension member biases the nozzle tip toward a surface of the component.

In some instances, the anti-pivoting force can be generally the same as a force applied by an individual onto the nozzle such that the nozzle tip remains in general contact with the component surface. For example and for illustrative purposes only, the anti-pivoting force can be between 0.4 and 0.6 kilogram-force. The tension member can be a coil spring; however, this is not required. For example and for illustrative purposes only, the tension member can be a hydraulic cylinder-piston unit, a leaf spring, a shape memory alloy spring, and the like.

A process for applying a smooth bead of the viscous liquid onto the component can include providing the component and the automated fluid dispenser as described above. The fluid dispenser can have a fluid reservoir containing the viscous liquid and a nozzle having a nozzle tip in fluid communication with the fluid reservoir.

The component is placed into contact with the nozzle tip such that the nozzle pivots about the pivot axis a predetermined amount and the component is displaced across the nozzle tip along a predetermined path at a predetermined speed. While the component is in motional contact with the nozzle tip, viscous liquid is forced through the nozzle at a predetermined flow rate. The ability of the nozzle and nozzle tip to stay generally in contact with the component surface and be flexible with respect to pivoting about the pivot axis, if and when the component and/or the fluid dispenser vibrates, affords for a smooth bead of the viscous liquid to be placed onto the component.

Figure 3:
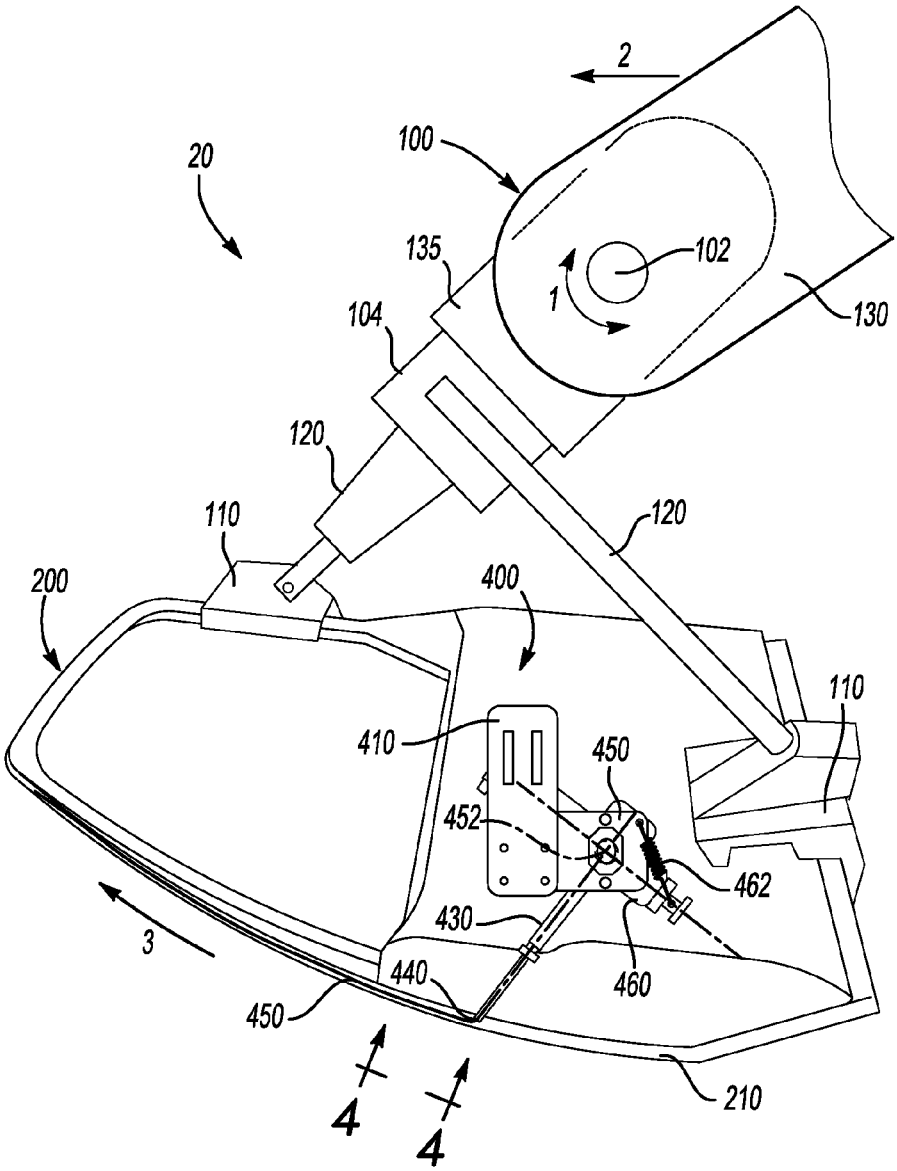
FIG. 3 is an illustration of an automated fluid dispenser according to an embodiment of the present invention.

Turning now to FIG. 3, an embodiment of an automated fluid dispenser according to the present invention is shown generally at reference numeral 20. The fluid dispenser 20 can include a robot 100 having a main arm 130 and a second arm 135. The second arm 135 can pivot about the main arm 130 about a pivot axis 102. In some instances, the second arm 135 can pivot about the main arm 130 in a clockwise (CW and/or counter-clockwise (CCW) direction 1.

The second arm 135 can have one or more extensions or arms 120 which have one or more clamps 110 attached thereto. In this manner, the robot 100 can grasp and hold a component such as an automotive door panel. An automated fluid dispenser 400 can include a support 410 with a fluid dispense valve 460, the fluid dispense valve 460 having a nozzle 430 with a nozzle tip 440. The fluid dispense valve 460 can be attached to a flange 450 about a pivot axis 452. It is appreciated that the fluid dispense valve 460 is operable to force a viscous fluid 450 through the nozzle tip 440. The fluid dispense valve 460 can further have a tension member 462 that provides an anti-pivoting force to the nozzle 430 when the nozzle pivots about the axis 452. As illustrated in the figure, the tension member 462 can have one end attached to the valve 460, another end attached to the flange 450, and can apply a CCW anti-pivoting force to the nozzle 430 when the nozzle and/or valve pivots CW about the pivot axis 452. In this manner, the nozzle tip 440 can be biased up against the component 200 such that the tip 440 stays in general contact therewith and a bead of the viscous liquid 450 can be applied to an edge portion 210 of the component 200.

The robot 100 can afford for the main arm 130 to move in a second direction 2 and in combination with the second arm 135 pivoting about the axis 102 provide movement of the component 200 along a predetermined path in a direction 3 as illustrated in the figure. As such, the component 200 can be brought into motional contact with the nozzle tip 440 and displaced relative to the tip 440 along a predetermined path at a predetermined speed. With the tip 440 flexibly in contact with the component 200, the bead 450 can have a smooth surface 452 as illustrated in FIG. 4.

Figure 5:
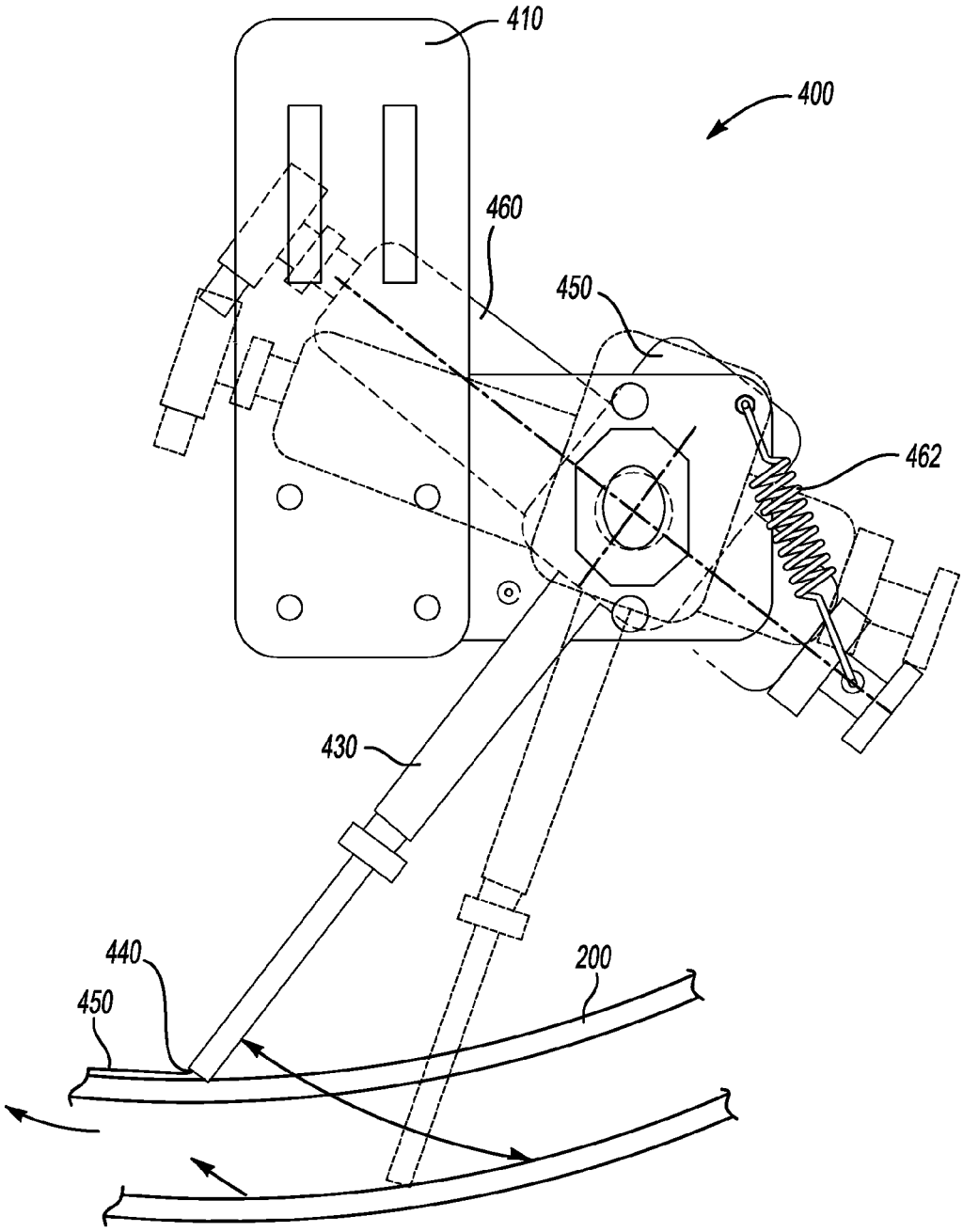
FIG. 5 is an enlarged view of an automated fluid dispenser valve shown in FIG. 3.

Turning now to FIG. 5, an enlarged view of the automated fluid dispenser 400 is shown. In addition, the dotted outline of the fluid dispense valve 460 illustrates how the valve pivots about the pivot axis 452 when the component 200 is brought into motional contact with the nozzle tip 440. It is appreciated that the fluid dispense valve 460 can afford for the viscous fluid 450 to exit from the nozzle tip 440 at a predetermined flow rate.

As illustratively shown in the figure, the tension member 462 applies a CCW anti-pivoting force which seeks to move or pivot the nozzle 430 CCW, but allows the nozzle to move in a clockwise direction when the component 200 is brought into contact with the tip 440. The tension member 462, illustratively shown as a coil spring, can be selected such that a predetermined amount of anti-pivot force is applied to the nozzle 430. It is appreciated that the amount of force can be adjusted depending on the size of the nozzle 430, the viscosity of the viscous liquid 450, the flow rate of the liquid 450, the speed at which the component 200 is displaced relative to the tip 440, and the like.

Figure 4:
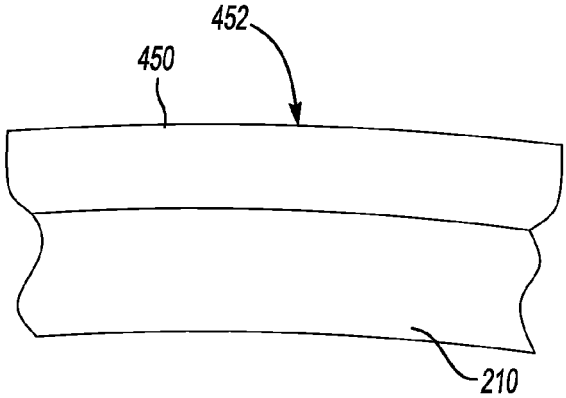
FIG. 4 is a side view of a bead applied to a component using the automated fluid dispenser illustrated in FIG. 3.

For example and for illustrative purposes only, for a viscous liquid such as a sealant Terokal® 5308™ applied to an edge region of an automotive door using a Snuf-Bak™ 2200-727 air operated fluid dispense valve having ¼ inch National Pipe Thread Fine (N.P.T.F.) inlet and outlet ports, an anti-pivoting force between 0.4 and 0.6 kilogram-force can provide appropriate pressure on the nozzle tip 440 such that it stays in general contact with the component 200 and applies a smooth bead as illustrated in FIG. 4. It is appreciated that different anti-pivoting forces could be used and/or required for different viscosity liquids, fluid dispense valves, and the like. It is also appreciated that the combination of the fluid dispense valve 460 being pivotally attached to the flange 450 with the tension member 462 provides a wrist and/or elbow-like movement that would be performed by an individual which can compensate for vibration of the component and/or fluid dispense valve.

The invention is not restricted to the illustrative examples and/or embodiments described above. The embodiments are not intended as limitations on the scope of the invention. Methods, apparatus, compositions, and the like described herein are exemplary and not intended as limitations on the scope of the invention. Changes therein and other uses will occur to those skilled in the art. The scope of the invention is defined by the scope of the claims.

I claim:

1. An automated fluid dispenser for smoothly applying a viscous fluid onto a component, said device comprising:

a fluid dispense valve having a nozzle with a nozzle tip extending from said fluid dispense valve, said fluid dispense valve having a pair of opposed ends;

a support, said fluid dispense valve pivotally attached to said support about a pivot axis and pivotable freely in one direction, said pivot axis located between said pair of opposed ends;

a tension member attached to said support and one of said pair of opposed ends of said fluid dispense valve;

wherein said tension member applies an anti-pivoting force to said fluid dispense valve in a direction opposite said one direction when said fluid dispense valve pivots about said pivot axis, for the purpose of smoothly applying a viscous fluid onto a component that has come into motional contact with said nozzle tip and caused said fluid dispense valve and said nozzle to pivot about said pivot axis.

2. The dispenser of claim 1, wherein said support is a stationary support and said motional contact is the component displaced across said nozzle tip at a predetermined speed.

3. The dispenser of claim 2, further comprising a robot, said robot operable to hold and displace the component across said nozzle tip at said predetermined speed.

4. The dispenser of claim 2, wherein said anti-pivoting force keeps said nozzle tip in contact with the component as the component is displaced across said nozzle tip.

5. The dispenser of claim 4, wherein said anti-pivoting force is between 0.4 and 0.6 kilogram-force.

6. The dispenser of claim 1, wherein said tension member is a spring.

7. An automated fluid dispenser for smoothly applying a viscous fluid onto a panel, said device comprising:

a fluid dispense valve having a nozzle with a nozzle tip extending from said fluid dispense valve, said fluid dispense valve having a pair of opposed ends;

a support, said fluid dispense valve pivotally attached to said support about a pivot axis and pivotable freely in one direction, said pivot axis located between said pair of opposed ends;

a tension member attached to said support and one of said pair of opposed ends of said fluid dispense valve; and a robot operable to hold and place the panel in motional contact with said nozzle tip;

wherein said tension member applies an anti-pivot force to said fluid dispense valve in a direction opposite said one direction when said fluid dispense valve pivots about said pivot axis and said nozzle tip moves flexibly and smoothly along the panel when the robot places the panel in motional contact with said nozzle tip.

8. The dispenser of claim 7, wherein said support is a stationary support and said motional contact is the panel displaced across said nozzle tip at a predetermined speed by said robot.

9. The dispenser of claim 7, wherein said anti-pivoting force keeps said nozzle tip in contact with the panel when the panel is in motional contact with said nozzle tip.

10. The dispenser of claim 9, wherein said anti-pivoting force is between 0.4 and 0.6 kilogram-force.

11. The dispenser of claim 7, wherein said tension member is a coil spring.

12. A process for applying a smooth bead of viscous fluid onto a component, the process comprising:

providing a component;

providing an automated fluid dispenser, the dispenser having:

a fluid dispense valve containing a viscous fluid;

a nozzle having a nozzle tip extending from the fluid dispense valve, the fluid dispense valve having a pair of opposed ends;

a support, the fluid dispense valve pivotally attached to the support about a pivot axis and pivotable freely in one direction, the pivot axis being located between the pair of opposed ends;

a tension member attached to the support and one of the pair of opposed ends of the fluid dispense valve;

wherein the tension member applies an anti-pivoting force to the fluid dispense valve in a direction opposite the one direction when the fluid dispense valve pivots about the pivot axis;

placing the component into contact with the nozzle tip such that the fluid dispense valve pivots about the pivot axis a predetermined amount;

displacing the component across the nozzle tip along a predetermined path at a predetermined speed; and flowing the viscous fluid from the fluid dispense valve and through the nozzle at a predetermined flow rate;

wherein a smooth bead of the viscous fluid is placed on the component.

13. The process of claim 12, further comprising providing a robot, the robot holding and moving the component along the predetermined path at the predetermined speed.

14. The process of claim 12, wherein the component is a panel.

15. The process of claim 12, wherein the tension member is a coil spring, the coil spring having one end attached to the support and one end attached to the nozzle.

16. The process of claim 12, wherein the anti-pivoting force is between 0.4 and 0.6 kilogram-force.

17. The process of claim 12, wherein the viscous fluid is a sealant material.

* * * * *